US008732886B2

(12) United States Patent
Engle et al.

(10) Patent No.: US 8,732,886 B2
(45) Date of Patent: May 27, 2014

(54) FLOOR MACHINE PIVOT JOINT

(75) Inventors: Joseph Engle, Hartville, OH (US); David Molnar, Hudson, OH (US)

(73) Assignee: The Imperial Electric Company, Akron, OH (US)

( * ) Notice: Subject to any disclaimer, the term of this patent is extended or adjusted under 35 U.S.C. 154(b) by 266 days.

(21) Appl. No.: 13/289,429

(22) Filed: Nov. 4, 2011

(65) Prior Publication Data

US 2013/0111679 A1 May 9, 2013

(51) Int. Cl.
*A47L 11/02* (2006.01)

(52) U.S. Cl.
USPC ..... 15/98; 15/97.1; 15/49.1

(58) Field of Classification Search
USPC ..... 15/98, 97.1, 144.1, 50.1, 50.2, 49.1
See application file for complete search history.

(56) References Cited

U.S. PATENT DOCUMENTS 6,374,447 B1 * 4/2002 Armbruster et al. ..... 15/28

* cited by examiner

*Primary Examiner* — Shay Karls
(74) *Attorney, Agent, or Firm* — Maginot, Moore & Beck, LLP

(57) ABSTRACT

The present invention is a floor machine pivot joint. The pivot joint utilizes pivot pegs attached to the base of the floor machine which extend from the base into cavities formed in the sides of the yoke which, in preferred embodiments, have either partially spherical or cylindrical shape. The pivot pegs allow the yoke to pivot in substantially one plane with reduced unwanted movement of the yoke and base relative to each other.

8 Claims, 5 Drawing Sheets

FLOOR MACHINE PIVOT JOINT

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE

Not Applicable.

BACKGROUND OF THE INVENTION

1. Field of the Invention

The present invention pertains to pivot joints. The invention more particularly concerns an improved pivot joint for use with floor machines such as floor polishers.

2. Discussion of the Background

An existing floor machine such as a floor polisher or vacuum may include a base comprising a motor housing, bumpers for avoiding scuffs on the base, a cavity for housing the components of the floor machine which are in operative contact with the floor, the operative components themselves (such as brushes), and tires or rollers, and the floor machine may further include a yoke having a handle for the user to grasp. The base and yoke of such a floor machine are, ideally, pivotally attached to allow the user to raise or lower the handle as it pivots about the base.

The pivotal attachment of the base and yoke of such a floor machine is currently achieved using cylindrical shafts inserted into bores. This type of pivotal attachment can be relatively simple with few moving parts compared to other existing designs, and thus may be less expensive to manufacture at relaxed tolerances for error, but suffers from a number of inherent pitfalls. Among them is the fact that use of this design requires a manufacturer to balance the need for a flush fit between such a cylindrical shaft and bore with the need to reduce manufacturing costs by relaxing machining tolerances such as those relating to shaft and bore shape and dimensions. The less perfectly a manufacturer machines the shaft and bore, the more jerky a user will find the floor machine's operation, but the cheaper the manufacturing process. For example, if the shaft is undersized even to a modest extent in relation to the bore it occupies, that disparity will be magnified along the length of the yoke such that a user will experience delayed resistance when trying to manipulate the handle. Because of this, the user may experience jerky and unsatisfactory operation of the floor machine.

Further, many manufacturers will attempt to remedy jerky operation resulting from such pivotal attachments by inserting plastic liners or similar materials into the areas where the shafts and bores are mated. While this may temporarily alleviate jerky operation of the floor machine, such quick fixes are an added cost for parts which are quickly worn down through usage, resulting in additional harm to users' confidence in the durability of their floor machines.

Finally, the shafts which form these pivotal attachments do not offer a user the option of easily adjusting a yoke relative to a base.

There is thus a need for an improved pivot joint providing for more beneficial combinations of adjustability, management of manufacturing costs, and smoothness of operation.

BRIEF SUMMARY OF THE INVENTION

In one form of the invention, the device includes a pivot joint for a floor machine having a yoke with proximal and distal ends relative to a user who grips the proximal end to operate the floor machine. The distal end has left and right sides, each of which have cavities formed along them. The pivot joint also includes a base having left and right sidewalls which define a recess in the base that receives the distal end of the yoke. Pivot pegs are attached to the base and extend inward therefrom toward the left and right sides of the yoke. The pivot pegs contact the yoke cavities at the pivot pegs' pivotal ends, which in a preferred embodiment are rounded and sized to fit within similarly rounded yoke cavities.

The foregoing are intended to be illustrative of the invention and are not meant in a limiting sense. Directional references such as to "left, right, proximal and distal" are included for ease of reference to the drawings and also are not meant in a limiting sense. Many possible embodiments of the invention may be made and will be readily evident upon a study of the following specification and accompanying drawings comprising a part thereof. Various features and subcombinations of invention may be employed without reference to other features and subcombinations.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims. A more complete appreciation of the invention and many of the advantages thereof will be readily obtained as the same becomes better understood by references to the detailed description when considered in connection with the accompanying drawings, wherein:

DETAILED DESCRIPTION OF THE INVENTION

Figure 1:
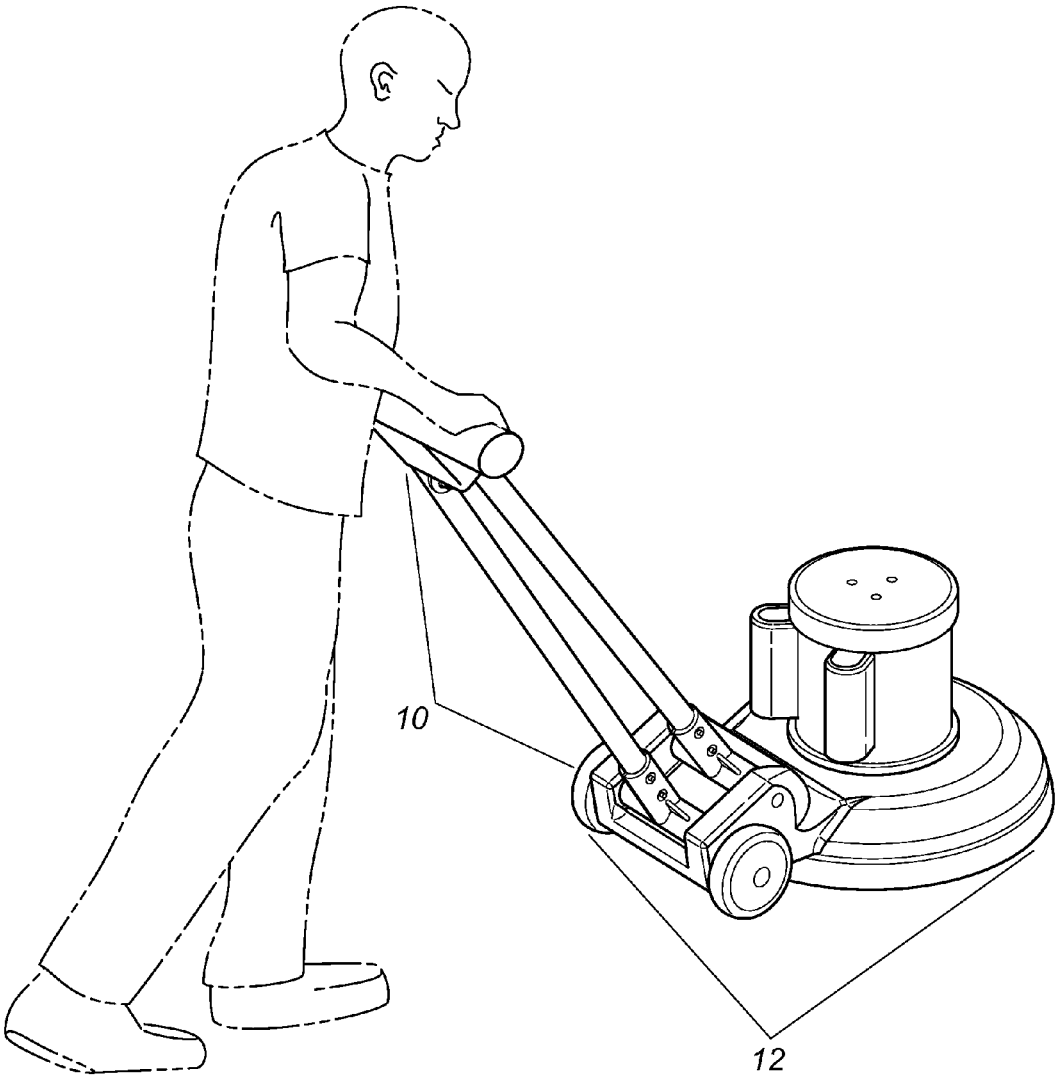
FIG. 1 is an elevated perspective of the rear right of an embodiment of the invention comprising a floor machine.

As required, one or more detailed embodiments of the present invention are disclosed herein; however, it is to be understood that the disclosed embodiments are merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring now to FIGS. 1-5, wherein like reference numerals designate identical or corresponding parts through the several views, an embodiment of the present invention is displayed therein.

FIG. 1 shows an embodiment of the invention comprising a floor polishing floor machine having a yoke 10 which extends from a proximal end near the hands of a user standing behind the machine down to a distal end which is pivotally attached to a base 12. A user may use this floor machine by driving the yoke 10 to push or pull the base 12 forward or backward, respectively. The user may also turn the floor machine by applying force in different directions to the proximal end of the yoke 10. It is desirable for many users that, when pushing, pulling or turning the floor machine, the force they apply is met with a smooth and relatively constant resistance from friction with the floor rather than inconsistent, delayed or jerky resistance which may be symptomatic of poor attachment of the yoke and base 10, 12. The embodiment of the invention shown in FIG. 1 helps reduce jerky operation by providing an improved pivotal attachment of the yoke to the base 10, 12. The design further employs fewer intermediary parts used to attach the yoke to the base 10, 12 relative to many previous designs, which also reduces the likelihood of jerky operation while allowing the user to pivot the yoke 10 along a substantially vertical plane when elevating or lowering its proximal end. It may also reduce the effects of wear and tear through use of fewer intermediary parts.

Figure 2:
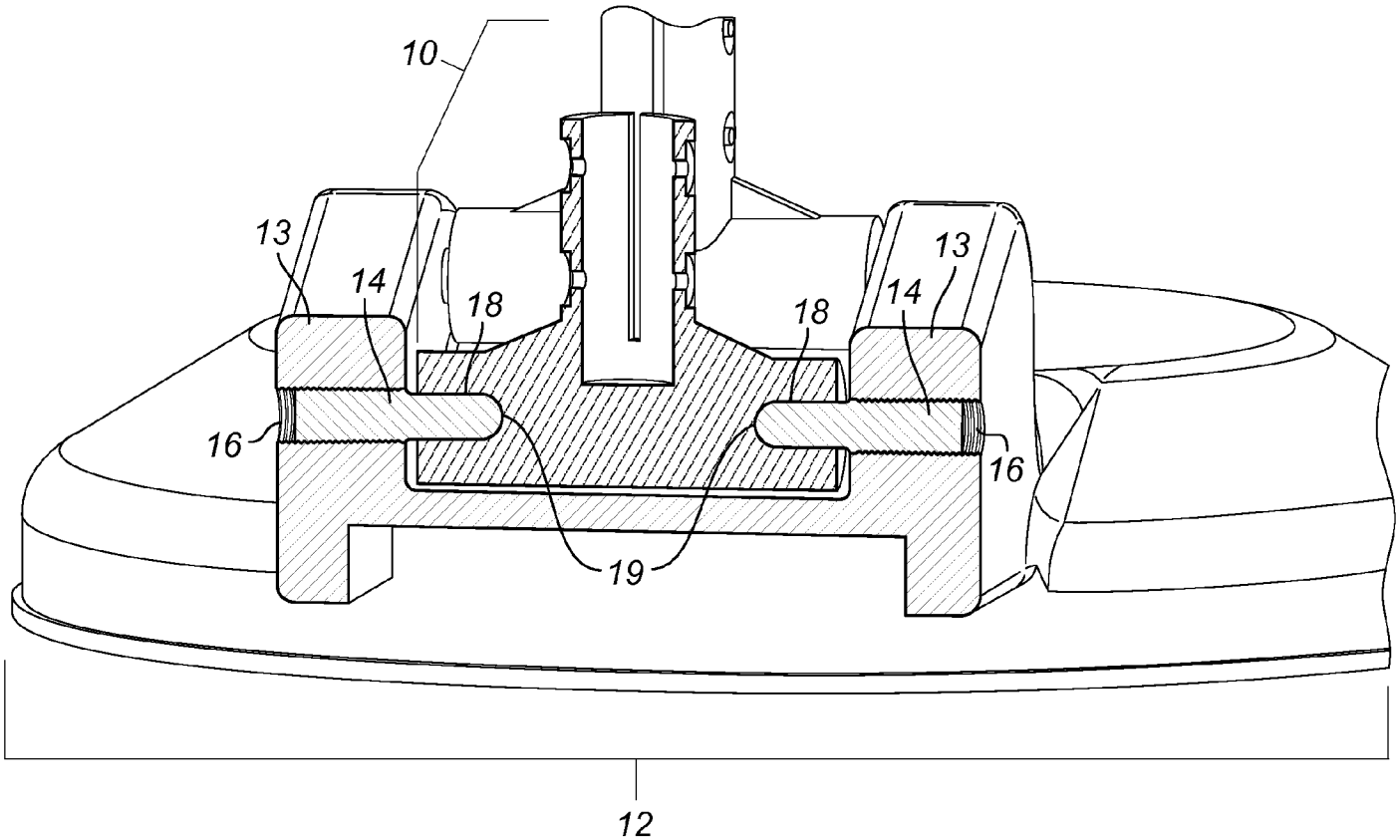
FIG. 2 is an exploded sectional elevated perspective of the rear right of an embodiment of the invention.

FIG. 2 shows an exploded sectional view of the embodiment of FIG. 1 and more clearly depicts the core of an embodiment of the pivot joint. In this embodiment, the distal end of the yoke 10 extends downward to terminate at a recess in the base 12 defined on left and right sides by sidewalls 13. The yoke 10 is attached to the sidewalls 13 by pivot pegs 14 which extend into yoke cavities 18 and thereby pivotally attach the yoke 10 to the base 12. In the embodiment of FIG. 2, the yoke cavities 18 are substantially cylindrical and define a horizontal axis running along their centers. The pivot pegs 14 extend outward from the left and right sides of the yoke 10 into the sidewalls 13 of the base 12 at threaded screw holes 16 bored along the width of the sidewalls 13 on the horizontal axis. The pivot pegs 14 may comprise any of a number of known screw designs having screw heads and threaded bodies for associating with the base 12, including designs associated with screws commonly known as "set screws" (which commonly do not have screw heads of greater diameter than the bodies), and in preferred embodiments additionally comprise rounded pivotal ends 19 which are machined to fit the yoke cavities 18 as described herein and exemplified by the embodiment of FIG. 2. In other embodiments, pivot pegs 14 may be attached to the base without threaded bodies or threaded screw holes 16 such as through use of welding, clips, pins, or other known means of attachment, and extend inward therefrom into the yoke cavities 18.

The embodiment of FIG. 2 comprises yoke cavities 18 with rounded terminuses. The pivot pegs' 14 rounded pivotal ends 19 are sized in this preferred embodiment to fit and rotate within the yoke cavities 18. Between uses, or during assembly, the pivot pegs 14 of the embodiment of FIG. 2 may be rotated within the threaded screw holes 16 using an appropriate tool such as a screw driver, Allen wrench, or other known tool. Other embodiments may comprise pivot pegs 14 which are rotatable by a user who grips the pivot pegs 14 at heads which extend beyond the outer surfaces of the sidewalls 13 along the horizontal axis. In the embodiments described in this paragraph, rotating a pivot peg 14 clockwise will move it further toward the yoke 10. Because the two pivot pegs 14 oppose each other on either side of the yoke 10, the horizontal position of the pivot pegs 14 may be adjusted to adjust the relative position of the yoke and base 10, 12 and to pivotally attach the yoke 10 to the base 12 at a fixed horizontal position.

The embodiment of FIG. 2 additionally allows for relaxed machining tolerances for certain manufacturing errors, which in turn may reduce production costs. While in the preferred embodiment shown the pivotal ends 19 of the pivot pegs 14 sit flush against the rounded terminuses of the yoke cavities 18, in production the pivotal ends 19 or terminuses of the yoke cavities 18 may be imperfectly machined so that they are of different shape, or so that the pivot pegs 14 themselves are of incorrect length. Additionally, the pivot pegs 14 may be misaligned due to, for example, threaded screw holes 16 which are bored imperfectly along the horizontal axis. This design allows for greater tolerance for these and other imperfections while still providing an operable pivot joint for floor machines. Rounded pivotal ends 19 further allow for relaxed machining tolerances at least because, when inserted into yoke cavities 18 and tightened therein, they will naturally settle into and center themselves in the rounded terminuses of the yoke cavities 18 despite imperfections such as those discussed briefly herein.

Figure 3:
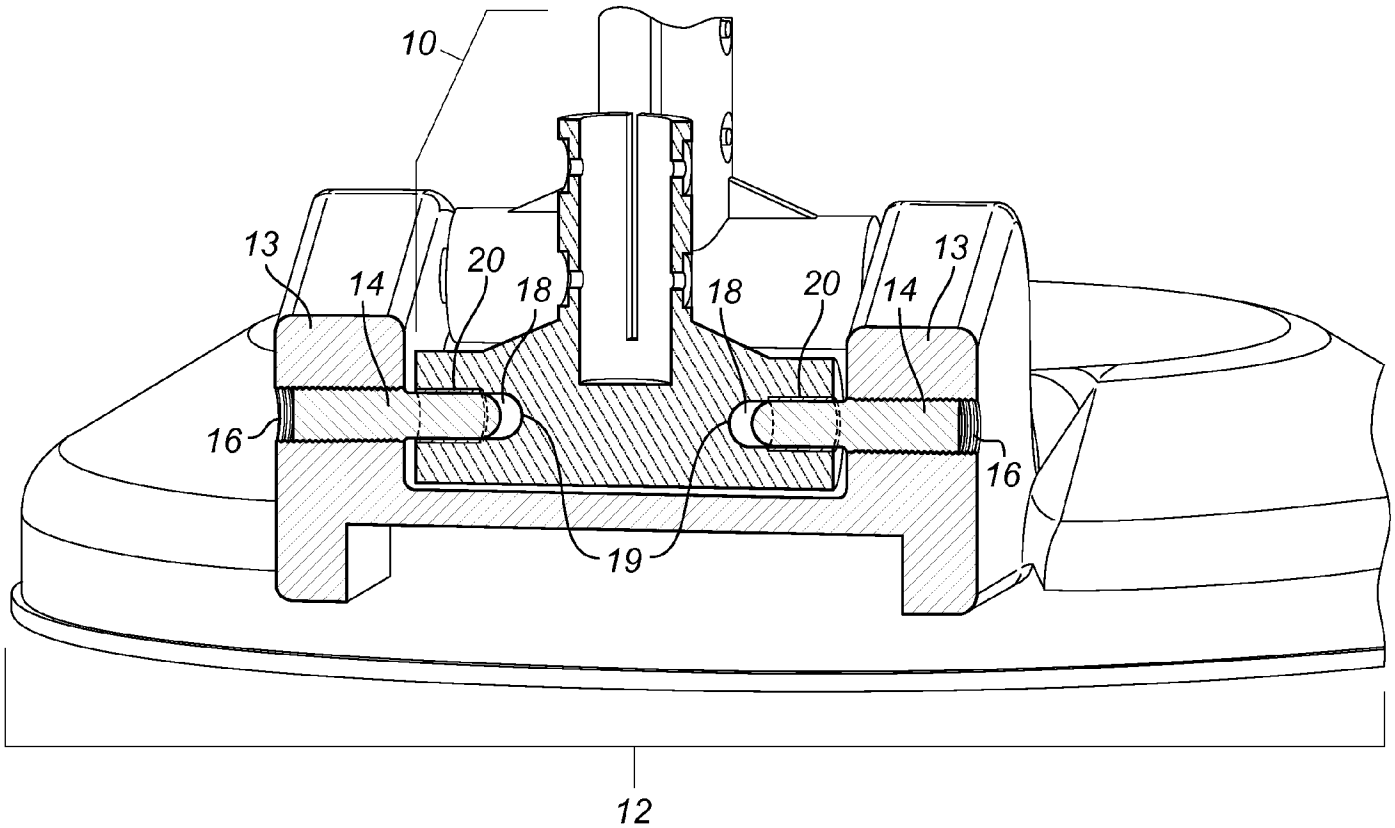
FIG. 3 is an exploded sectional elevated perspective of the rear right of an embodiment of the invention further comprising bushing at a pivotal interface area.

Referring now to FIG. 3, another embodiment is shown wherein bushing 20, in this case bronze bushing, is fixed within each of the yoke cavities 18 for receiving the pivot pegs 14 and providing pivotal interfaces. The pivot pegs' 14 pivotal ends 19 are shown removed slightly from the terminuses of the yoke cavities 18, and may be further rotated within the yoke cavities 18 to complete adjustment and pivotal attachment of the yoke and base 10, 12. Bushing 20 may be attached to the yoke cavities 18 using known fasteners or by applying force to form friction fits with the yoke cavities 18. The bushing 20 is sized appropriately to fit within the yoke cavities 18 of embodiments of the invention and receive pivot pegs 14 such that they can pivot in the bushing 20. The bushing 20 may extend the life of the pivot pegs 14 and/or yoke cavities 18 by providing a more durable interface between them, or may expand the field of acceptable materials of which they may be comprised.

Figure 4:
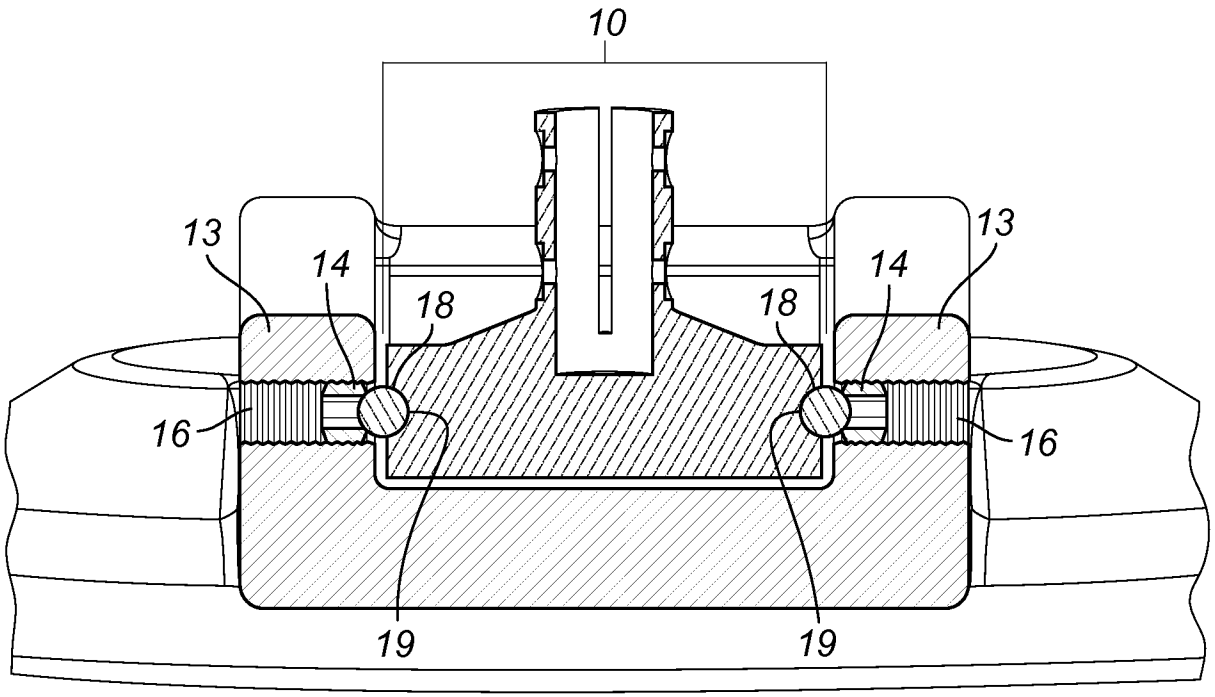
FIG. 4 is an exploded sectional rear view of an embodiment of the invention having pivot pegs with ball bearings at the interface with the yoke.

Referring now to FIG. 4, this embodiment of the invention comprises pivot pegs 14 having threaded bodies and machined to present rounded pivotal ends 19 comprising ball bearings. The pivot pegs 14 have concave recesses machined to receive the ball bearings to form rounded pivotal ends 19 for insertion into the yoke cavities 18. In this embodiment, the yoke cavities 18 are shaped as partial spheres. This embodiment also allows adjustment of the relative positions of the yoke and base 10, 12 by turning the pivot pegs 14 to adjust their horizontal positions and pivotally attach the yoke 10 to the base 12. It likewise offers the advantage of providing for pivoting of the yoke 10 about the base 12 and reduction of movement in unwanted directions and jerkiness in operation. This embodiment also allows a greater tolerance for manufacturing error.

Figure 5:
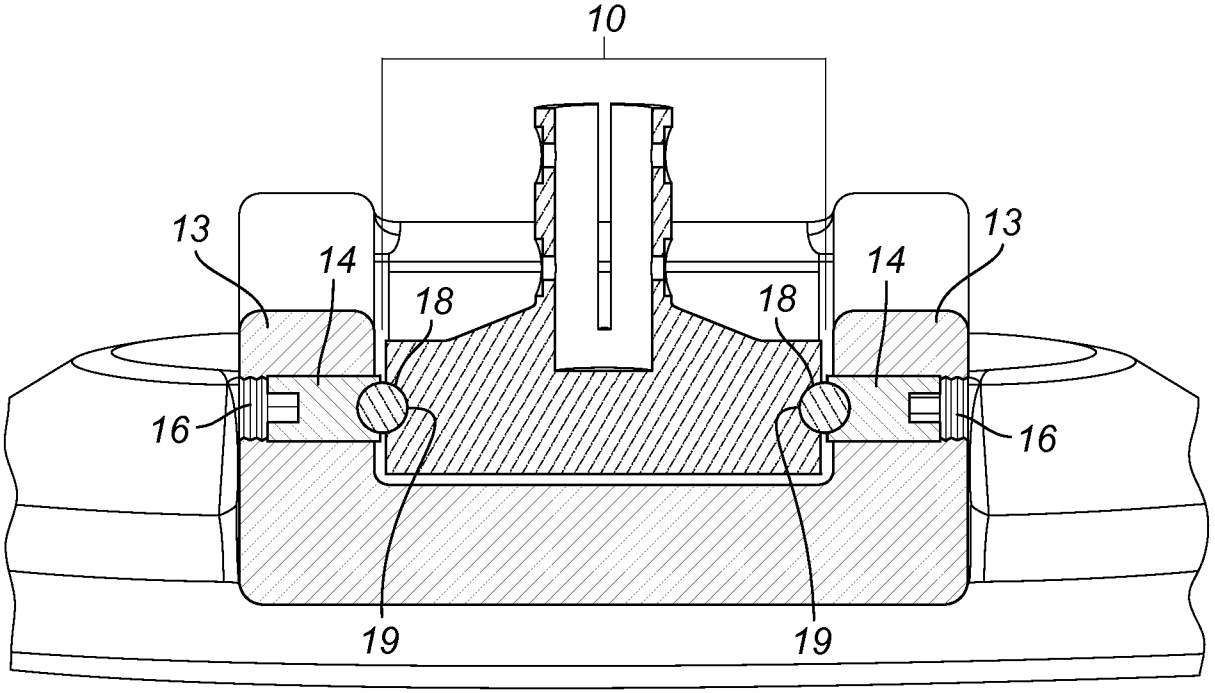
FIG. 5 is an exploded sectional rear view of an embodiment of the invention having pivot pegs which are set screws and which are adjustable using wrenches.

Referring now to FIG. 5, this embodiment also employs a pivot peg 14 with a rounded pivotal end 19 comprising a ball bearing. The pivot peg 14 of this embodiment comprises a "set screw" without a traditional screw head, but instead having a recess with a hexagonal cross section into which an Allen wrench, for example, may be inserted to rotate the pivot peg 14 and adjust the relative horizontal position of the yoke and base 10, 12.

In additional embodiments, for example those having pivotal ends 19 comprising ball bearings, portions of the bodies of the pivot pegs 14 may take non-cylindrical shape where they do not contact yoke cavities 18 nor threaded screw holes 16, without departing from the spirit of the invention.

These and other uses of, and modifications to, the present invention will be apparent to those of skill in the art upon reading this disclosure.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall there between.

What is claimed is:

1. A pivot joint for use with a floor machine, the pivot joint comprising:

a yoke having a proximal end and a distal end;

a base pivotally attached to the distal end of the yoke using pivot pegs, the pivot pegs comprising ball bearings attached to the yoke at yoke cavities into which the pivot pegs extend, the yoke cavities having rounded terminuses sized to receive the ball bearings of the pivot pegs; and wherein the pivot pegs may be adjusted to adjust the relative position of the yoke and base.

2. The pivot joint according to claim 1 wherein the pivot pegs are attached to the base at threaded screw holes in the base.

3. A floor machine comprising:

a yoke having a proximal end and a distal end;

a yoke cavity formed at each of a left side and a right side of the distal end of the yoke; and, a base pivotally attached to the distal end of the yoke using pivot pegs attached to the base and extending therefrom into the yoke cavities, the pivot pegs comprising ball bearings and the yoke cavity of the left side and the yoke cavity of the right side having rounded terminuses sized to receive the ball bearings of the pivot pegs.

4. The floor machine according to claim 3, wherein the floor machine is a floor polisher.

5. The floor machine according to claim 3 wherein the pivot pegs are attached to the base at threaded screw holes and the pivot pegs are adjustable to adjust the relative position of the yoke and the base.

6. A pivot joint for use with a floor machine, the pivot joint comprising:

a yoke having a proximal end and a distal end and the distal end has a left side and a right side, a yoke cavity formed at each of the left side and the right side, and wherein a horizontal axis is defined by a line passing through the centers of the yoke cavities;

a base having a left sidewall and a right sidewall that define a recess in the base; and a pair of pivot pegs attached to the base that extend from the base into the yoke cavities of the left side and the right side of the yoke to pivotally connect the yoke and the base, the pivot pegs comprising ball bearings and the yoke cavities have rounded terminuses sized to receive the ball bearings.

7. The pivot joint according to claim 6, wherein the pivot pegs are adjustable along the horizontal axis to adjust the relative position of the base and the yoke.

8. The pivot joint according to claim 6 wherein the pivot pegs are attached to the base at threaded screw holes and are adjustable to adjust the relative position of the yoke and the base.

* * * * *